United States Patent [19]

Trinkwalder, Jr.

[11] 4,372,343

[45] Feb. 8, 1983

[54] PRESSURE-RETAINING VALVE AND METHOD OF RETAINING PRESSURE

[75] Inventor: Joseph C. Trinkwalder, Jr., North Tonawanda, N.Y.

[73] Assignee: Sherwood Selpac Corp., Lockport, N.Y.

[21] Appl. No.: 246,166

[22] Filed: Mar. 23, 1981

[51] Int. Cl.[3] ..... F16K 17/26

[52] U.S. Cl. ..... 137/614.2; 137/493; 137/539.5; 222/545

[58] Field of Search ..... 137/539.5, 493, 613, 137/614.2; 222/396, 545

[56] References Cited

U.S. PATENT DOCUMENTS

| | | | |
|---|---|---|---|
| 2,192,141 | 2/1940 | McElwaine | 137/614.2 |
| 2,415,258 | 2/1947 | Parker et al. | 137/539.5 |
| 3,285,274 | 11/1966 | Bouvier | 137/493 |
| 3,981,328 | 9/1976 | Yonezawa | 137/614.2 |
| 4,210,168 | 7/1980 | Yonezawa | 137/614.2 |

*Primary Examiner*—A. Michael Chambers
*Attorney, Agent, or Firm*—Sommer & Sommer

[57] ABSTRACT

A cylinder valve is adapted to be mounted on a container storing a pressurized fluid. The cylinder valve has a main gate valve which is selectively operable to control the flow of such fluid. The cylinder valve further includes a pressure-retaining valve which automatically closes, when the pressure differential between the inlet and outlet falls below a predetermined minimum, to prevent further flow from the cylinder, independent of the operation of the gate valve. The pressure-retaining valve includes a ball biased to move toward an O-Ring, and adapted to pass through the O-Ring when the container is refilled.

13 Claims, 3 Drawing Figures

PRESSURE-RETAINING VALVE AND METHOD OF RETAINING PRESSURE

BACKGROUND OF THE INVENTION

1. Field of the Invention

The present invention relates generally to the field of cylinder valves which function to meter the flow of fluid, such as LPG, propane or the like, from a storage container, and more particularly to an improved cylinder valve which functions to retain a positive pressure within the container independent of the operation of the primary flow-metering valve.

2. Description of the Prior Art

Cylinder valves are, of course, known.

U.S. Pat. Nos. 3,981,328 (U.S. Class 137/614.2) and 4,210,168 (Class 137/454.5) both disclose cylinder valves having a positive pressure-retaining feature.

While such valves are known, it is believed that prior art constructions are unduly complicated and unnecessarily expensive to manufacture.

SUMMARY OF THE INVENTION

The present invention provides an improvement in a cylinder valve adapted to be mounted on a container storing a usable quantity of pressurized fluid to selectively vary the flow of the fluid from the container, the cylinder valve having a body provided with a passageway therethrough, the passageway having an inlet at one end thereof adapted to communicate with the stored fluid and having an outlet at its other end, and including a valve means, such as a gate valve, selectively operable to meter the flow of fluid through the passageway.

In one aspect, the improvement broadly comprises a pressure-retaining valve mounted on the body and operatively associated with the passageway to prevent the pressure at the inlet from equalizing with the pressure at the outlet, the pressure-retaining valve including: an annular seat mounted on the body about the passageway and facing away from the inlet; a poppet member mounted on the body for movement toward and away from the seat; an end cap threaded into the body and having a recess extending into the end cap from one end thereof, the end cap also having at least one opening penetrating the wall about the recess and through which fluid may normally flow; and spring means engaging the body and urging the poppet member to move toward the seat, the force exerted by the spring on the poppet member being equal in magnitude to an opposing force exerted on the poppet member by a predetermined differential between the pressures at the inlet and outlet, such that when such pressure differential falls below the predetermined differential, the poppet member will move toward and sealingly engage the seat to interrupt further flow through the passageway; whereby the pressure-retaining valve may cause a quantity of pressurized fluid to be retained within the container after a usable quantity of such fluid has been withdrawn therefrom.

In another aspect, the invention also provides a unique improvement in a body provided with a fluid flow passageway therethrough, the passageway having an inlet at one end thereof and having an outlet at its other end. The improvement comprises: a pressure-retaining valve mounted on the body and operatively associated with the passageway to normally prevent the pressure at the inlet from equalizing with the pressure at the outlet. The pressure-retaining valve broadly includes: an annular seat mounted on the body about the passageway and facing away from the inlet; a poppet member mounted on the body for movement toward and away from the seat, one of the poppet member and seat being formed of a resilient material; a spring engaging the body and urging the poppet member to move toward the seat, the force exerted by the spring on the poppet member being equal in magnitude to an opposing force exerted on the poppet member by a predetermined differential between the pressures at the inlet and outlet such that, when such pressure differential falls below the predetermined differential, the poppet member will move toward and sealingly engage the seat to interrupt flow through the passageway. The poppet member is also adapted to move through the seat, by deformation of the resilient poppet member or seat, to permit a reverse flow through the passageway from the outlet to the inlet.

The poppet member may move back through the seat, again by permissive deformation, when normal flow (from the inlet to the outlet) thereafter resumes. Hence, in use, the improvement performs a unique method of regulating the flow of fluid through a passageway.

Accordingly, a general object of the present invention is to provide an improved cylinder valve incorporating a pressure-retaining feature.

Another object is to provide an improved cylinder valve which will retain pressure within a fluid storage container, so as to prevent the introduction of contaminants into the container, and which will allow the container to be refilled.

Another object is to provide an improved pressure-retaining valve in which a poppet member will pass through an annular seat to allow a reverse flow of fluid through a passageway.

Another object is to provide an improved method of regulating the flow of fluid through a passageway.

These and other objects and advantages will become apparent from the foregoing and ongoing specification, the drawings and the appended claims.

DESCRIPTION OF THE PREFERRED EMBODIMENTS

Figure 1:
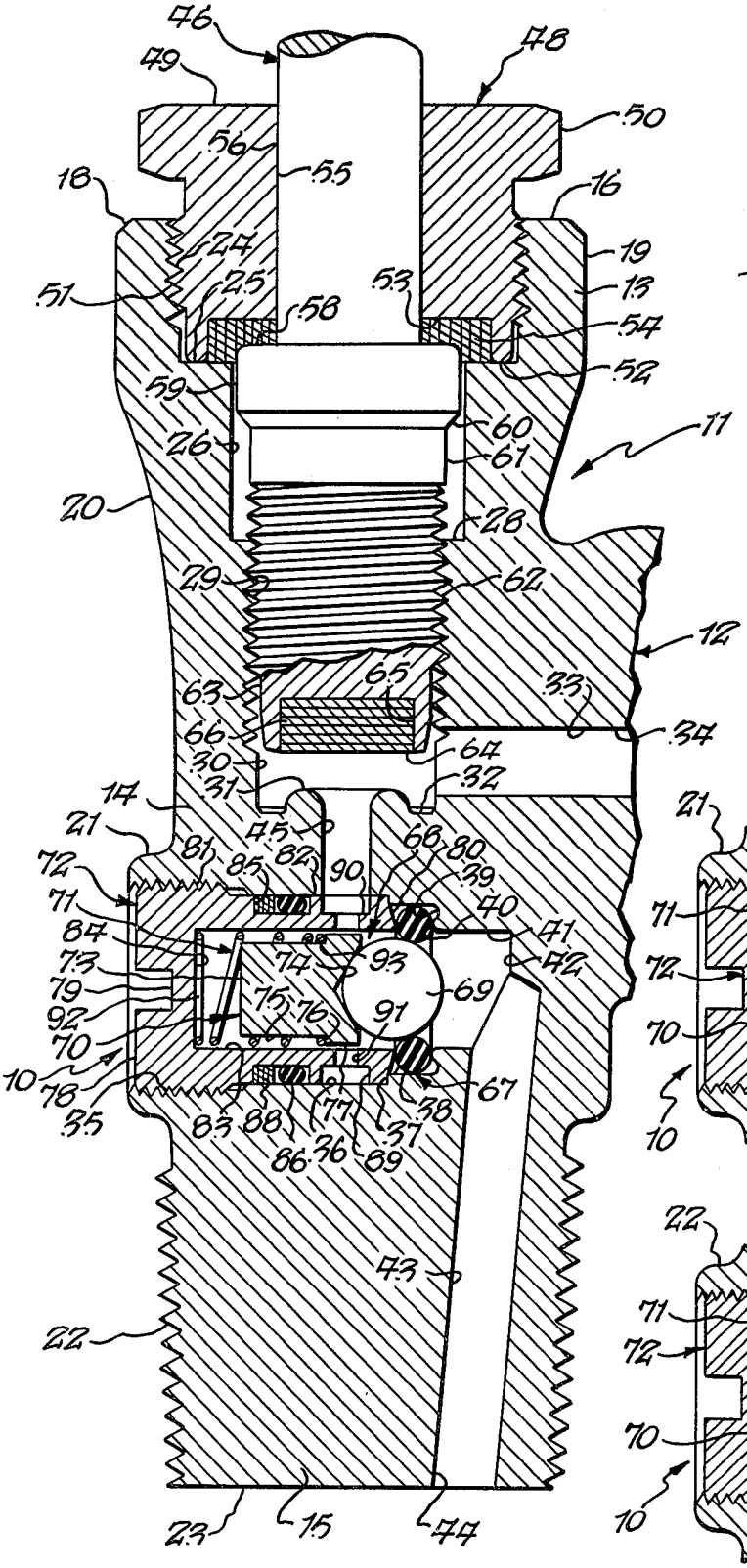
FIG. 1 is a fragmentary vertical sectional view through an improved cylinder valve, this view showing the pressure-retaining valve in a closed condition.

At the outset, it should be clearly understood that like reference numerals are intended to identify the same elements and/or structure consistently throughout the several drawing figures, as such elements and/or structure may be further described or explained by the entire written specification, of which this detailed description is an integral part.

Referring now to the drawings, and more particularly to FIG. 1 thereof, the invention provides an improvement, of which the presently preferred embodiment is generally indicated at 10, which may be incorporated in a cylinder valve, generally indicated at 11.

The cylinder valve 11 is adapted to be mounted on a container (not shown) in which a quantity of fluid is stored, and is selectively operable to vary the flow of fluid from the container. Such containers typically include "cylinders" in which a gaseous fuel, such as LPG, propane, or the like, is stored. However, the present invention is not limited to use with such fuels or such cylinder valves, and is of general utility. As used herein, the term "fluid" is intended to be generic to gases and liquids.

Adverting now to FIG. 1, the improved cylinder valve 11 is shown as including a body, of which a pertinent fragment is indicated at 12. Body 12 is shown as having an uppermost collar portion 13, an intermediate trunk portion 14 from which a boss extends rightwardly and is provided with a suitable outlet fitting (not shown), and a lowermost stem portion 15.

More specifically, body 12 is shown as having, exteriorly: an upwardly-facing horizontal annular surface 16, a chamfered annular corner 18, a cylindrical (or hexagonal, if desired) surface 19 extending downwardly therefrom, an inwardly-tapered arcuate transitional surface 20, an outwardly and leftwardly extending raised boss 21, and a downwardly and inwardly inclined tapered surface provided with external threads 22 continuing downwardly therefrom to join the lowermost circular horizontal end face 23.

Internally, body 12 has a plurality of passages. A first passage extends downwardly into the body from its upper surface 16, and is bounded by: an internally-threaded portion 24 extending downwardly from body surface 16, an upwardly-facing annular horizontal shoulder 25, a cylindrical surface 26, an upwardly-facing annular horizontal shoulder 28, an internally-threaded portion 29 continuing downwardly therefrom, a cylindrical surface 30, and an upwardly-facing arcuate seat surface 31 surrounded by an annular groove 32 which extends further downwardly into the body.

A second passage includes a horizontal hole 33, extending leftwardly through the rightward outlet fitting (not shown) and opening through cylindrical surface 30 of the first passage. As used herein, the rightward marginal end of horizontal hole 33 is denominated the outlet 34. If the outlet fitting had been shown, the outlet might be regarded at the marginal end thereof.

A third passage extends horizontally into the body from the left side thereof, and is bounded by: an internally-threaded portion 35, a cylindrical surface 36 continuing rightwardly therefrom, a leftwardly-facing annular vertical shoulder 37, a cylindrical surface 38 continuing rightwardly therefrom; a leftwardly-facing annular surface 39 having a somewhat sinusoidal cross-section terminating in a leftwardly-facing arcuate seat surface 40, cylindrical surface 41 continuing rightwardly therefrom, and a leftwardly-facing surface 42.

A fourth passage includes a cylindrical hole 43 extending upwardly from body surface 23 and joining third passage surfaces 41 and 42. The lower end of hole 43 is denominated the inlet 44.

The first and third passages communicate through a vertical through-hole bounded by cylindrical surface 45. Hence, the inlet 44 and outlet 34 are connected by a passageway which is generally bounded by cylindrical surfaces 43, 41, 38, 36, 45, 30 and 33.

The main valve means for varying the flow through the passageway includes a gate valve which is selectively movable upwardly and downwardly relative to the upwardly-facing main valve seat 31. This gate valve includes a stem 46 penetrating a cap 48.

Cap 48 has an annular horizontal upper surface 49; an outer surface including hexagonal portion 50, and externally-threaded portions 51 mating with body threads 24; and a lowermost annular horizontal lower surface 52, and provided with a cylindrical recess 53 extending upwardly into cap 48 from its lower surface 52 . A suitable packing material 54 is arranged in recess 53. The cap is further provided with a vertical through-bore 55.

The valve stem 46 is bounded by an upper cylindrical rod 56 penetrating cap bore 55, an upwardly-facing annular horizontal surface 58, a cylindrical surface 59 continuing downwardly therefrom, a downwardly and inwardly inclined frusto-conical surface 60, a cylindrical surface 61 continuing downwardly, an externally-threaded portion 62 matingly engaging body threads 29, a cylindrical surface 63 continuing downwardly therefrom, and a lowermost annular horizontal end face 64 from which a cylindrical recess 65 extends upwardly into the stem. Recess 65 is filled with a suitable packing material 66 and is adapted to be selectively moved toward and away from seat 31, by suitable rotation of stem 46, to provide the primary means for regulating the flow of fluid through the passageway. Of course, a suitable handle (not shown) is mounted on the upper end of rod 46, and may be grasped and selectively rotated to move packing 66 upwardly or downwardly (as desired) relative to seat 31.

The present invention provides an improved pressure-retaining valve 10 which is mounted in the body third passage and is operatively associated with the passageway to prevent the pressure of fluid at inlet 44 from normally equalizing with the pressure at outlet 34. In FIG. 1, the improved valve 10 is shown as including an annular seat member 67; a two-piece poppet member, generally indicated at 68, and including a spherical ball 69 and a ball-retainer 70; a spring 71; and an end cap 72.

The seat member 67 is shown as being a resilient O-Ring operatively arranged in the body third passage so as to abut leftwardly-facing sinusoidal body surface 39 of body cylindrical surface 38.

The ball 69 is shown as being of such a diameter that it will engage O-Ring 67 and sealingly close its central opening, when urged rightwardly with sufficient force.

The ball-retainer 70 is shown as being a specially-configured member having a circular vertical left end face 73; a rightwardly-divergent conical right end face 74; and a stepped outer surface including (from left to right in FIG. 1): a cylindrical surface 75 extending rightwardly from left end face 73, a leftwardly-facing annular vertical shoulder 76, and a horizontal cylindrical surface 77 continuing rightwardly therefrom to join right end face 74. The conical right face of the ball-retainer is adapted to engage and center ball 69.

The end cap 72 is also a specially-configured member having a circular vertical left end face 78 provided with a diametrical slot 79 to accomodate a suitable turning tool, such as a screwdriver (not shown); and an opposite rightwardly-facing outwardly-divergent generally frusto-conical annular surface 80; and outer surface including (from left to right in FIG. 1) an externally-threaded portion 81 extending rightwardly from left end face 78 and adapted to matingly engage body threads 35, and a horizontal cylindrical surface 82 continuing rightwardly to join right end face 80. The end cap 72 is further provided with a recess extending leftwardly into the end cap from its right end face 80. This recess is bounded by a horizontal cylindrical surface 83 extending leftwardly from end face 80, and a circular vertical bottom 84.

The end cap is shown as being also provided with an annular groove 85, having a rectangular cross-section, which extends radially into the end cap from cylindrical surface 82. An O-Ring 86 and suitable packing 88 are arranged in groove 85 and sealingly engage facing body surface 36 to prevent leakage of the serviced fluid therepast. The end cap is shown as being further provided with one or more radial through-holes to permit fluid flow. In FIG. 1, two of such holes are shown, and each is depicted as being bounded by a cylindrical surface 89 extending radially inwardly from outer surface 82, an outwardly-facing annular surface 90, and a cylindrical surface 91 continuing radially inwardly therefrom to join recess cylindrical surface 83. Hole surface 89 is approximately the same diameter as, and is roughly aligned with the internal body passage bounded by cylindrical surface 45, although this may be varied as desired.

The spring 71 is specifically shown as being a coil spring, having linear force-to-displacement characteristics within its operating range, and is arranged such that its left marginal end portion 92 will abut recess bottom 84 and its right marginal end portion 93 will abut ball-retainer shoulder 76. Since spring 71 is in compression, the ball-retainer will be continuously urged to move rightwardly toward the seat. The rightward force exerted by the spring on the poppet member may be adjusted or varied by selective rotation of the end cap 72, thereby varying its position relative to body. Such selective rotation will vary the compressed displacement of spring 71, and, concomitantly, the rightward force exerted by the spring on the ball-retainer.

Figure 2:
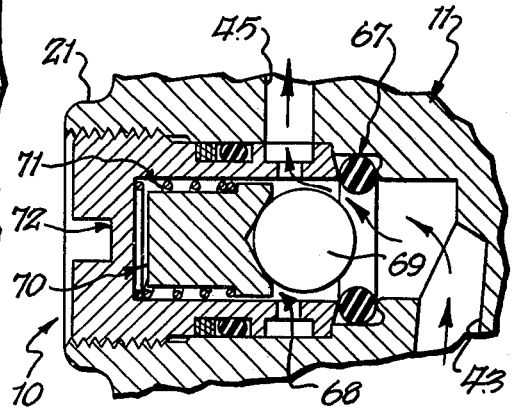
FIG. 2 is a fragmentary view of the pressure-retaining valve, similar to FIG. 1, but showing the pressure-retaining valve in an open condition.
Figure 3:
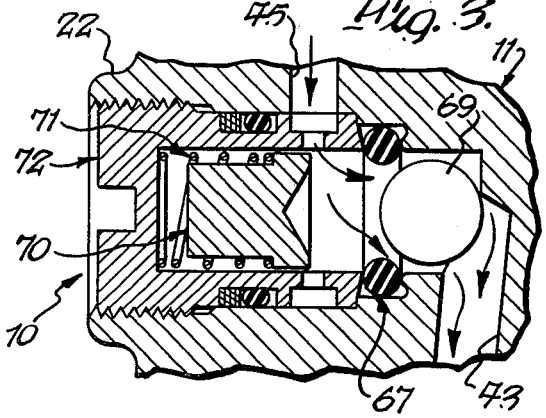
FIG. 3 is a fragmentary view of the pressure-retaining valve, similar to FIG. 2, but showing the ball as having passed through the seat to permit reverse flow from the outlet to the inlet when the container is refilled.

In FIG. 1, the improved pressure-retaining valve 10 is shown in a closed condition, with ball 69 sealingly engaging seat 67 so as to prevent fluid flow through the passageway, independent of the operation of the main gate valve. In FIG. 2, valve 10 is shown in an open condition, with the ball 69 displaced leftwardly away from seat 67 so as to permit such flow. In FIG. 3, the ball is shown as having passed through the O-Ring when the container is refilled.

Persons skilled in this art will appreciate that when cylinder valve 11 is mounted on a cylinder containing a stored fluid under pressure, a pressure differential will exist between the inlet 44 and the outlet 34. The improved pressure-retaining valve 10 functions to retain some pressure within the cylinder so as to prevent the introduction of foreign material and contaminants. If the pressure within the cylinder were to equalize with ambient pressure, undesirable contaminants might enter the cylinder if the main gate valve were left open. However, by retaining a positive pressure within the cylinder, a cylinder valve incorporating the improved pressure-retaining valve 10 will effectively prevent the introduction of such contaminants, even if the main gate valve were to be left open.

To accomplish this function, the position of the end cap 72 relative to the body is adjusted so that the force exerted by spring 71 on the ball-retainer 70 will be equal in magnitude to the opposing force exerted on the ball 69 by a predetermined differential between the pressures at the inlet and the outlet, such that when such pressure differential falls below the predetermined minimum, the spring will displace ball 69 rightwardly into sealing engagement with O-Ring seat 67. In this closed condition, the rightward force exerted by the spring on the poppet member will be greater than the differential pressure acting on the rightwardly-facing projected end face of the ball.

If the pressure differential is greater than the predetermined minimum, as when the gate valve is opened, ball 69 will be displaced leftwardly away from the seat, so as to permit such flow. Hence, the pressure-retaining valve will not interfere with normal operation of the gate valve while a usable quantity of the stored fluid is consumed. Only when the differential pressure falls below a predetermined minimum, will the ball 69 sealingly engage seat 67 to as to trap or retain a positive pressure within the container.

After the usable contents have been withdrawn, the container may be refilled by connecting the outlet fitting (not shown) to a suitable source, and by opening the gate valve so as to permit a reverse flow of fluid (i.e., from the outlet to the inlet) through the passageway. Normally, one could expect that this reverse flow would be prevented by the operation of the pressure-retaining valve 10. However, either the ball 69 or the O-Ring seat 67 is formed of a resilient material. Hence, when the container is refilled, the ball will pass through the O-Ring, through permissible deformation of the resilent member, to enter the chamber bounded by body surfaces 41 and 42, as shown in FIG. 3. In this condition, fluid may flow through the seat and around the ball to refill the container through passage 43. Hence, the ball moves to a flow-permitting out-of-the-way position (FIG. 3) until the operator opens the gate valve so as to resume normal flow (i.e., from the inlet to the outlet) through the passageway. When this occurs, the ball passes back through the seat, again by permissible deformation thereof, to its operative flow-regulating position (leftwardly of the seat), shown in FIGS. 1 and 2.

Hence, in use, the pressure-retaining valve 10 performs the method of regulating the flow of fluid through a passageway, which method comprises the steps of: providing an annular seat about the passageway facing away from the inlet; biasing a poppet member to move toward the seat against the opposing force caused by a differential pressure between the inlet and outlet acting on the poppet member; causing the poppet member to move toward and sealingly engage the seat when such pressure differential falls below a predetermined minimum; and permitting the poppet member to pass through the seat to reopen the passageway, through deformation of one of the seat and poppet member, when fluid flows from the outlet to the inlet. Such method may include the further step of: causing the poppet member to move back through the seat, through deformation of the one of the seat and poppet member, when fluid again flows from the inlet to the outlet. Hence, the ball automatically moves to an out-of-the-way position when the cylinder is refilled, and automatically resets itself to an operative position when normal flow is thereafter resumed.

Of course many changes and modifications may be made. Different springs, or springs of different spring rates, may be readily substituted. Similarly, the particular configuration of the body and its various passages may be readily modified. In some cases, the ball-retainer may be omitted, and the spring may bear directly against the ball.

Hence, the scope of the invention should be measured by the scope of the appended claims.

What is claimed is:

1. In a body provided with a fluid flow passageway therethrough, said passageway having an inlet at one end thereof and having an outlet at its other end, the improvement which comprises:

a pressure-retaining valve mounted on said body and operatively associated with said passageway to normally prevent the pressure at said inlet from equalizing with the pressure at said outlet, said pressure-retaining valve including an annular seat mounted on said body about said passageway and facing away from said inlet;

a poppet member mounted on said body for movement toward and away from said seat, one of said seat and poppet member being formed of a resilient material;

a spring engaging said body and urging said poppet member to move toward said seat, the force exerted by said spring on said poppet member being equal in magnitude to an opposing force exerted on said poppet member by a predetermined differential between the pressures at said inlet and outlet such that, when such pressure differential falls below said predetermined differential, said poppet member will move toward and sealingly engage said seat to interrupt flow through said passageway, said poppet member being also adapted to move through said seat by deformation of said one resilient member to permit a reverse flow through said passageway from said outlet to said inlet.

2. The improvement as set forth in claim 1 wherein said seat is an O-Ring formed of a resilient material.

3. The improvement as set forth in claim 2 wherein said poppet member includes a ball.

4. The improvement as set forth in claim 1 wherein said poppet member is arranged to move back through said seat after said reverse flow has terminated and after normal flow from said inlet to said outlet has resumed.

5. In a cylinder valve adapted to be mounted on a container storing a usable quantity of pressurized fluid to selectively vary the flow of said fluid from said container, said cylinder valve including a body provided with a passageway therethrough, said passageway having an inlet at one end thereof adapted to communicate with said stored fluid and having an outlet at its other end, and including valve means selectively operable to meter the flow of fluid through said passageway, the improvement which comprises:

a pressure-retaining valve mounted on said body and operatively associated with said passageway to prevent the pressure at said inlet from equalizing with the pressure at said outlet, said pressure-retaining valve including:

an annular seat mounted on said body about said passageway, said seat facing away from said inlet;

a poppet member including a ball and ball-retainer mounted on said body for movement toward and away from said seat;

an end cap threaded into said body and having a recess extending into the end cap from one end thereof, said end cap also having at least one opening penetrating the wall about said recess and through which fluid may normally flow; and a spring engaging said end cap and ball-retainer for urging said ball to move toward and sealingly engage said seat, the force exerted by said spring on said ball-retainer being equal in magnitude to an opposing force exerted on said ball by a predetermined differential between the pressures at said inlet and outlet, such that when said pressure differential falls below said predetermined differential, said ball will move toward and sealingly engage said seat to interrupt further flow through said passageway and wherein said container may be refillable through said outlet by having said ball pass through said seat to permit said container to be refilled through said passageway;

whereby said pressure-retaining valve may cause a quantity of fluid to be retained within said container after a usable quantity of said fluid has been withdrawn therefrom.

6. The improvement as set forth in claim 5 wherein said body is provided with an annular shoulder surrounding said passageway and facing away from said inlet.

7. The improvement as set forth in claim 5 wherein said seat is a resilient member.

8. The improvement as set forth in claim 6 wherein said seat is a resilient member arranged to abut said shoulder.

9. The improvement as set forth in claim 5 wherein said spring is a coil spring.

10. The improvement as set forth in claim 5 wherein a surface on said end cap is adapted to engage said seat.

11. The improvement as set forth in claim 10 wherein said body is provided with an annular shoulder surrounding said passageway and forcing away from said seat, and wherein said seat is a resilient member.

12. The method of regulating the flow of fluid through a passageway having an inlet end and an outlet end, comprising the steps of:

providing an annular seat about said passageway facing away from said inlet;

biasing a poppet member to move toward said seat against the opposing force caused by a differential pressure between said inlet and outlet acting on said poppet member;

causing said poppet member to move toward and sealingly engage said seat when said pressure differential falls below a predetermined minimum; and permitting said poppet member to pass through said seat to reopen said passageway, through deformation of one of said seat and poppet member, when fluid flows from said outlet to said inlet.

13. The method as set forth in claim 12 and further comprising the additional step of:

causing said poppet member to move back through said seat, through deformation of said one of said seat and poppet member, when fluid again flows from said inlet to said outlet.

* * * * *